United States Patent [19]

Nieuwendijk et al.

[11] 4,200,851

[45] Apr. 29, 1980

[54] DEFLECTION UNIT FOR AN IN-LINE COLOR CATHODE-RAY TUBE

[75] Inventors: Joris A. M. Nieuwendijk; Nicolaas G. Vink, both of Eindhoven, Netherlands

[73] Assignee: U.S. Philips Corporation, New York, N.Y.

[21] Appl. No.: 933,829

[22] Filed: Aug. 15, 1978

[30] Foreign Application Priority Data

Aug. 26, 1977 [NL] Netherlands ..... 7709431

[51] Int. Cl.[2] ..... H01F 7/00

[52] U.S. Cl. ..... 335/210; 335/213

[58] Field of Search ..... 335/210, 212, 213

[56] References Cited

U.S. PATENT DOCUMENTS

| | | | |
|---|---|---|---|
| 4,041,428 | 8/1977 | Kikuchi et al. | 335/213 X |
| 4,122,422 | 10/1978 | Hasegawa et al. | 335/213 |

*Primary Examiner*—George Harris

*Attorney, Agent, or Firm*—Thomas A. Briody; William J. Streeter; Edward W. Goodman

[57] ABSTRACT

A deflection unit for use in a color cathode-ray tube of the in-line type and having a line and a frame deflection winding, which deflection unit can be made to be self-converging for cathode-ray tubes of the same series having different screen formats by moving the line and frame deflection windings with respect to each other.

8 Claims, 5 Drawing Figures

DEFLECTION UNIT FOR AN IN-LINE COLOR CATHODE-RAY TUBE

BACKGROUND OF THE INVENTION

The invention relates to a deflection unit for use in a color cathode-ray tube of the in-line type having on the display screen a structure of uninterrupted phosphor lines, comprising:

a yoke ring of ferromagnetic material, a saddle-shaped first deflection winding surrounded by the yoke ring and having a front and a rear end for deflecting, in a first direction, electron beams generated in the cathode-ray tube, the electron beams, when the deflection unit is provided on a cathode-ray tube, passing through the winding in the direction from the rear to the front end;

a second deflection winding likewise having a front and a rear end for deflecting in a direction transverse to the first direction electron beams generated in the cathode-ray tube, all this in such manner that the generally used means for the correction of the dynamic convergence can be omitted.

For some time a color cathode-ray tube has become the vogue in which three electron beams are used in one plane; the type of such a cathode-ray tube is usually referred to as "in-line". For reducing convergence errors of the electron beams, use is generally made of a deflection unit having a frame deflection winding which generates a magnetic field of the cushion-shaped type, and having a line deflection winding which generates a magnetic field of the barrel-shaped type. In particular such a deflection unit may show the combination of a saddle-shaped line deflection winding with a frame deflection winding wound toroidally on the yoke.

However, the use of such a "self converging" deflection unit with a given geometry in cathode-ray tubes of the "in-line" type only results in complete elimination of convergence errors with one given screen format. So either the main geometry (for example the length of the winding) must be varied such that a given deflection unit is self-convergent for a different screen format, or extra correction means must be provided. From a point of view of manufacture, however, it is extraordinarily attractive to provide a deflection unit which is self-convergent with different screen formats without it being necessary for the main dimensions of line and frame deflection windings to be varied and without it being necessary to provide extra correction means.

SUMMARY OF THE INVENTION

It is the object of the invention to provide a deflection unit which satisfies the above-mentioned requirements.

The deflection unit according to the invention is characterized in that the front ends of the first and second windings are positioned at a distance S from each other, the deflection unit, when provided on a cathode-ray tube, being self-convergent for a first screen format and, with a variation Δ S of the distance S, being self-convergent for a second screen format by moving the second winding, with respect to the first winding, in which it holds that:

$$\Delta S = \alpha \Delta Z_S,$$

wherein $\Delta Z_S$ is the variation in distance between the front end of the first winding and the screen, and $0.05 < \alpha < 0.3$.

Both the first and the second deflection windings may be saddle-shaped (and the second deflection winding may also be surrounded by the yoke ring), in which the windings are constructed with a flat rear end (so-called shell winding) which can facilitate the movement of the windings with respect to each other.

Within the scope of the invention, a construction of the deflection unit, in which the second deflection winding is provided toroidally around the yoke ring, makes the movement of the second deflection winding (together with the yoke ring) particularly simple so that such a (hybrid) construction can very easily be made suitable for several screen formats of one series.

In the present case the value of $\alpha$ is approximately 0.1. Dependent on the design of the deflection unit, $\alpha$ may vary between approximately 0.05 and 0.3, so that the distance Δ S, over which the second deflection winding has to be moved with respect to the first, may be smaller or larger dependent on the specific design.

Starting with a given deflection unit, by varying the distance S it proves to be possible to make the y-fault in the corners, when the axes are self-converging (so-called crossing), to be zero for any screen format of a distinct series (for example, a 90° series with 14, 16, 18 and 20 inch screens). In order to maintain full convergence on the axes, it may sometimes be necessary to slightly vary the distribution of the conductors which form the windings (within a few degrees). The main geometry, however, remains unchanged.

The invention also relates to a color cathode-ray tube of the in-line type, having on the display screen a structure of uninterrupted phosphor lines, comprising a self-converging deflection unit as described above.

DESCRIPTION OF THE DRAWINGS

The invention will now be described in greater detail, by way of example, with reference to the drawings. In the drawings.

DESCRIPTION OF THE PREFERRED EMBODIMENT

Figure 1:
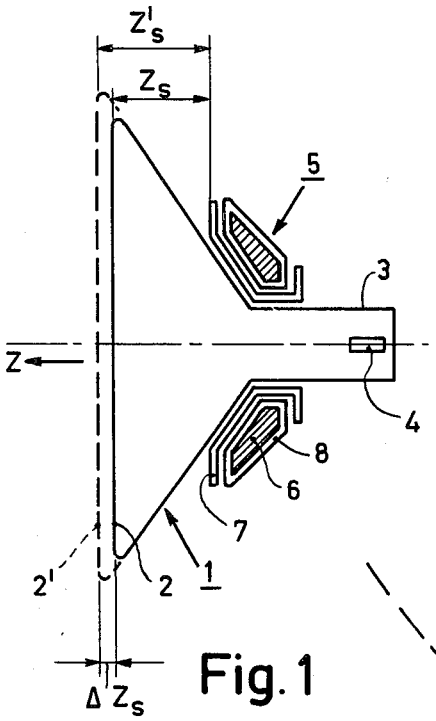
FIG. 1 shows diagrammatically a cathode-ray tube having a deflection unit.

FIG. 1 is a cross sectional view of a color display tube of the in-line type having a display screen 2, a tube neck 3 and three electron guns 4 situated in one plane. A deflection unit 5, secured to the display screen, comprises a rotationally symmetrical yoke ring 6, a set of saddle coils 7 for the line deflection (the so-called line winding) and a set of coils 8 for the frame deflection provided toroidally around the yoke ring 6 (the so-called frame winding).

It has been found that starting from a given geometry of line and frame windings, the sliding movement of the frame winding with respect to the line winding is a very helpful parameter in adjusting the third order anisotropic astigmatism (crossing). The sensitivity of the variation of the crossing with respect to the mutual movement of the deflection points is a factor of ten larger than, for example, the movement of the whole deflection system (in which the axes are always converged).

Up till now it has been generally thought that in the construction of the in-line deflection system, it was not permissible to deviate from the requirement, accepted in the construction of delta-deflection systems, that line and frame deflection centers should coincide and should go on coinciding upon deflection. As will be described hereinafter, the invention is based on the fact that, in a deflection unit of the in-line type destined for use in combination with display tubes having a (uninterrupted) line structure of the phosphors, the location of line and frame deflection centers can just be optimalised in behalf of convergence and frame performance.

In the last few years, color display systems have experienced a development which can be characterized by two features:

the delta arrangement of electron guns has been changed to an in-line arrangement, in which the associated deflection system has been developed from non-self-converging to self-converging, the hexagonal mask structure of the display tube has been changed into a line structure.

Where the system has to satisfy requirements with respect to the convergence, frame shapes and purity (color purity, landing reserve and the like), requirements can be derived which each of the composing components of said system have to satisfy (for instance the specific wire distribution for self-convergence, and the like).

Where purity is concerned, the general situation is that a deflection unit is given (which satisfies requirements as regards convergence, frame and shifting space), it being one of the objects of the display tube designers to develop such an analogy of the electron optical properites of said deflection unit that, during the manufacture of the display screen, the exposure optics ensure that the (visual) exposure "point" and the deflection "point" will afterwards coincide.

Because, for a delta-gun arrangement coupled to a non-self-converging deflection unit, the triodistortion (and the variation in deflection point), upon deflection, already results in conflicting requirements imposed upon the exposure optics, a generally accepted requirement imposed from purity on the properties of the deflection unit is that, in a delta system:

line and frame deflection points will coincide and will go on coinciding upon deflection.

In in-line self-converging color television display systems, the variation in deflection point of line and frame is already so different in character that is was deemed necessary at the time to abandon the hexagonal mask structure which was substantially ideal with respect to purity properties (read: guard band) and to proceed to a line structure. Said line structure is characterized by uninterrupted phosphor lines. (which, with "visibility" requirements imposed upon the mask structure remaining the same, have half the width of the original round phosphor dot).

These uninterrupted phosphor lines have the favorable result that, in the direction in which they extend, in principle, no mislanding (which means a beam not landing on a dot of its own color) can occur.

As a result of this, the different variation in deflection point of the frame winding with respect to the line winding can easily be permitted.

In that case it is in principle, no longer of any importance for purity whether line and frame deflection points will coincide also in the case of a deflection of approximately 0°.

In other words the generally accepted requirement in a delta system that in a deflection unit line and frame deflection points will coincide and will go on coinciding upon deflection, may be omitted in an in-line system when replacing the hexagonal mask structure in the display tube by a line mask structure (N.B.: and not as a result of the in-line arrangement of the electron guns!).

Within the scope of the invention this is used in the application of the deflection unit 5 in a display tube having a screen 2' of a screen format different from that of the display screen 2.

How this works will be described in detail with reference to FIGS. 2 and 3.

Figure 2:
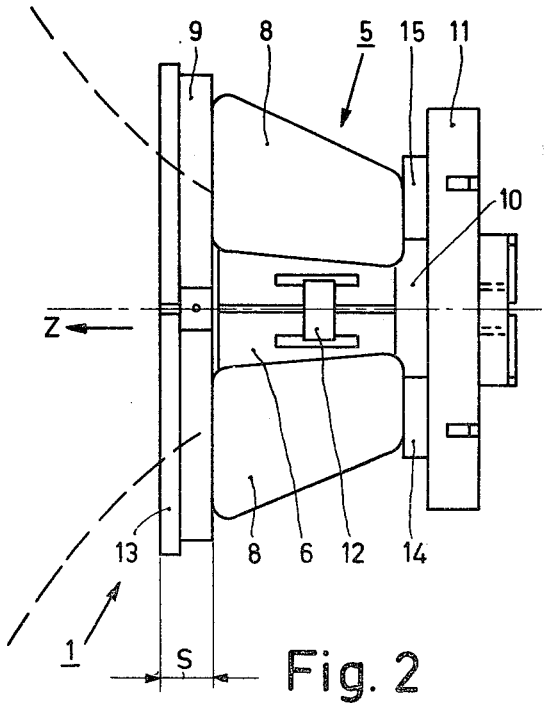
FIG. 2 shows diagrammatically a deflection unit according to the invention and suitable for use in a cathode-ray tube of a first screen format.

FIG. 2 is a side elevation of the deflection unit 5 shown in FIG. 1.

The deflection unit 5 is supported by an assembly cap of which the front part 9, the central part 10 and the rear part 11 are visible in the figure. The yoke ring 6 consists of two parts which are held together by clamping springs, one of which, denoted by reference numeral 12, is visible. The frame winding 8 is provided toroidally around the yoke ring 6. Only the front side—or front flap—13 of the line winding 7 is visible. In order that the deflection unit 5 be self-converging on a display screen 1 having a given screen format (for example a 90° tube with an 18" screen), the frame winding 8 has a given position with respect to the line winding 7 in which position it is fixed by means of filling blocks 14 and 15. The distance between the front end 13 of the line winding 7 and the front end of the frame winding 8 is denoted by S.

Figure 3:
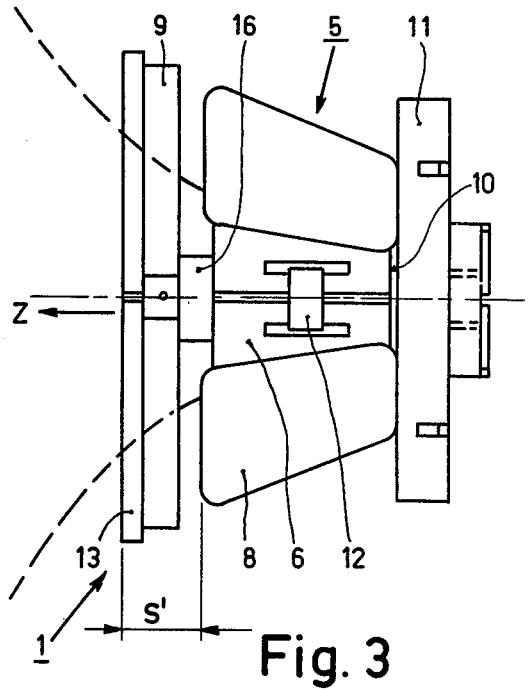
FIG. 3 shows diagrammatically the deflection unit of FIG. 2, this time made suitable for use in a cathode-ray tube having a second, larger screen format.

FIG. 3 in which, as in FIG. 2, the same reference numerals are used for the same components as in FIG. 1, shows that the distance S has been varied into the distance S' by removing the blocks 14 and 15, moving the frame winding 8 and fixing it in the new position by means of a filling block 16. The deflection unit 5 is now self-converging on a display tube having a second (larger) screen format (for example a 90° tube with a 20" screen). For this purpose the frame winding 8 in the present case has been moved rearwards by approximately 5 mm while the screen format was varied by 2", which is reflected in FIG. 1 by the distance $\Delta Z_s$, by which the distance from the first end of the line winding 7 to the display screen 2' has been increased.

Figure 4:
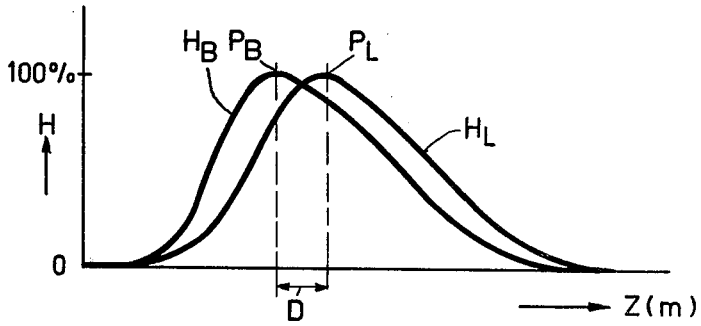
FIG. 4 is a graph showing the magnetic fields generated in the axial direction by the deflection unit shown in FIG. 2.

In a deflection unit of the configuration shown in FIG. 2, the magnetic fields show such a distribution in the axial direction Z that the place $P_L$ (the Gauss line deflection point) of the peak value of the line field $H_L$ lies at a given small distance D from the place $P_B$ (the Gauss frame deflection point) of the peak value of the frame field $H_B$, as is shown in FIG. 4.

Figure 5:
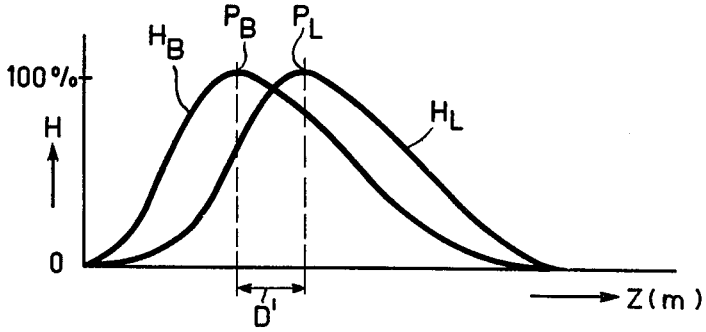
FIG. 5 is a graph showing the magnetic fields generated in the axial direction by the deflection unit shown in FIG. 3.

When the deflection unit has the configuration as shown in FIG. 3, it is found that the distance D' between the line deflection point $P_L$ and the frame deflection point $P_B$ is larger than that which is shown in FIG. 5.

When $D'-D=\Delta D$, the relationship holds that $\Delta D=\beta\Delta Z_S$, where $\Delta Z_S$ is the variation in the distance between the front end of the line winding and the display screen, and $\beta$ is a factor which depends on the specific design of the deflection unit, where $0.05<\beta<0.2$.

The distance Δ S over which the frame winding (together with the yoke ring) is moved, is slightly larger than the variation Δ D which occurs in the deflection point distance because when the frame winding is moved together with the yoke ring, the line field will also move slightly.

We claim:

1. A deflection unit, for use in a color cathode-ray tube of the in-line type having on the display screen a structure of uninterrupted phosphor lines, comprising:

a yoke ring of ferromagnetic material;

a saddle-shaped first deflection winding surrounded by the yoke ring and having a front and a rear end for deflecting in a first direction electron beams generated in the cathode-ray tube, the electron beams, when the deflection unit is provided on a cathode-ray tube, passing through the winding in the direction from the rear to the front end, a second deflection winding, likewise having a front and a rear end, for deflecting in a direction transverse to the first direction electron beams generated in the cathode-ray tube, wherein the front ends of the first and the second deflection windings are positioned at a distance S from each other, whereby the deflection unit, when provided on a cathode-ray tube, is self-converging for a first screen format and, with a variation Δ S of the distance S, is self-converging for a second screen format by moving the second winding with respect to the first winding, in which it holds that: $S=\alpha\Delta Z_s$ where:

$Z_s$ is the variation in distance between the front end of the first winding and the screen, and $0.05<\alpha<0.3$.

2. A deflection unit as claimed in claim 1, wherein the second deflection winding is saddle-shaped and is also surrounded by the yoke ring.

3. A deflection unit as claimed in claim 1, wherein the second deflection winding is provided toroidally around the yoke ring and the deflection unit, in the case of a variation Δ S of the distance S, is self-converging for a second screen format by moving the combination of the yoke ring with second winding with respect to the first winding.

4. A color cathode-ray tube of the in-line type having on the display screen a structure of uninterrupted phosphor lines comprising a self-converging deflection unit as claimed in claim 1, 2 or 3.

5. A method for producing deflection units for color television picture tubes of the in-line type having the same deflection angle and neck diameter but a different screen size, said method comprising:

providing a saddle-shaped first deflection winding having a front and a rear end for deflecting in a first direction electron beams generated in the picture tube, the electron beams, when the deflection unit is provided on a picture tube, passing through the winding in the direction from the rear to the front end, providing a second deflection winding likewise having a front and a rear end for deflecting, in a direction transverse to the first direction, electron beams generated in the picture tube, providing a yoke ring of ferro-magnetic material around at least the first deflection winding, shaping all first deflection windings on first dome-shaped jigs having identical dome sizes and shaping all second deflection windings on second dome-shaped jigs having identical dome sizes and varying the spacing between the front ends of the first and the second deflection windings depending on the screen size of the picture tube for which the relevant deflection unit is intended.

6. A method as claimed in claim 5, which further comprises winding the second deflection winding toroidally around the yoke ring and wherein the spacing between the front ends of the first and second deflection windings is varied by moving the yoke ring with the second deflection winding with respect to the first deflection winding.

7. A set of deflection units for color television picture tubes of the in-line type having the same deflection angle and neck diameter, but different screen sizes, each deflection unit being provided with:

a saddle-shaped first deflection winding having a front and a rear end for deflecting in a first direction electron beams generated in the picture tube, the electron beams, when the deflection unit is provided on a picture tube, passing through the winding in the direction from the rear to the front end, a second deflection winding likewise having a front and a rear end for deflecting in a direction transverse to the first direction electron beams generated in the picture tube, a yoke ring of ferromagnetic material surrounding at least the first deflection winding, wherein the main geometry of all first deflection windings and the main geometry of all second deflection windings of the set of deflection units are identical while the spacing between the front ends of the first and the second deflection windings of a given deflection unit depends on the screen size of the picture tube for which this deflection unit is intended.

8. A set of deflection units as claimed in claim 7, wherein for each deflection unit the second deflection winding is provided toroidally around the yoke ring.

* * * * *